United States Patent [19]

Trafford

[11] 4,070,086

[45] Jan. 24, 1978

[54] VARIABLE LENGTH ELECTRICAL CONNECTOR

[75] Inventor: Larry F. Trafford, Chatsworth, Canada

[73] Assignee: General Signal Corporation, Rochester, N.Y.

[21] Appl. No.: 585,916

[22] Filed: June 11, 1975

Related U.S. Application Data

[63] Continuation-in-part of Ser. No. 435,801, Jan. 23, 1974, abandoned.

[51] Int. Cl.[2] ..... H01R 9/02; H01R 9/10

[52] U.S. Cl. ..... 339/198 H; 339/272 A

[58] Field of Search ..... 339/17 C, 198 G, 198 GA, 339/198 H, 272 R, 272 A, 272 UC, 217 S

[56] References Cited

U.S. PATENT DOCUMENTS

| | | | |
|---|---|---|---|
| 2,780,791 | 2/1957 | Morschel | 339/198 GA |
| 2,967,290 | 4/1971 | Zeller | 339/272 R |
| 3,609,640 | 9/1971 | Reynolds et al. | 339/217 S X |
| 3,638,172 | 1/1972 | Adam | 339/272 R X |
| 3,701,087 | 10/1972 | Bernard | 339/272 A X |
| 3,715,707 | 2/1973 | Anderson | 339/272 A X |
| 3,824,524 | 7/1974 | Glover | 339/217 S X |
| 3,864,005 | 2/1975 | Klein | 339/272 R |

FOREIGN PATENT DOCUMENTS

| | | | |
|---|---|---|---|
| 1,093,738 | 11/1954 | France | 339/272 R |
| 1,221,837 | 1/1960 | France | 339/198 H |

*Primary Examiner*—Roy Lake
*Assistant Examiner*—Howard N. Goldberg
*Attorney, Agent, or Firm*—Pollock, Vande Sande & Priddy

[57] ABSTRACT

An electrical connector means comprising a plurality of individual units which may be coupled end-for-end to provide a multiple-conductor connecting means of any desired length. Each of the individual units comprises an outer housing of an electrically non-conductive material and defining on its outer surfaces male and female dovetail coupling means so that a plurality of such units can be mechanically connected together. The outer housing defines an axial bore for receiving a metallic connector which includes a conductor clamping means. The housing further defines a transverse bore extending through one sidewall, other than the one defining a dovetail coupling means, into the axial bore. An electrical conductor can be inserted into the transverse bore so that the end of the conductor can be received into and clamped by the clamping means which includes a clamping screw. The conductor clamping means at the end thereof opposite the screw includes a projecting pin which fits into an axial aperture in the housing communicating with the axial bore, thereby permitting such pin to extend out of the bottom of the housing and be inserted into a corresponding aperture in, for example, a printed circuit card.

8 Claims, 6 Drawing Figures

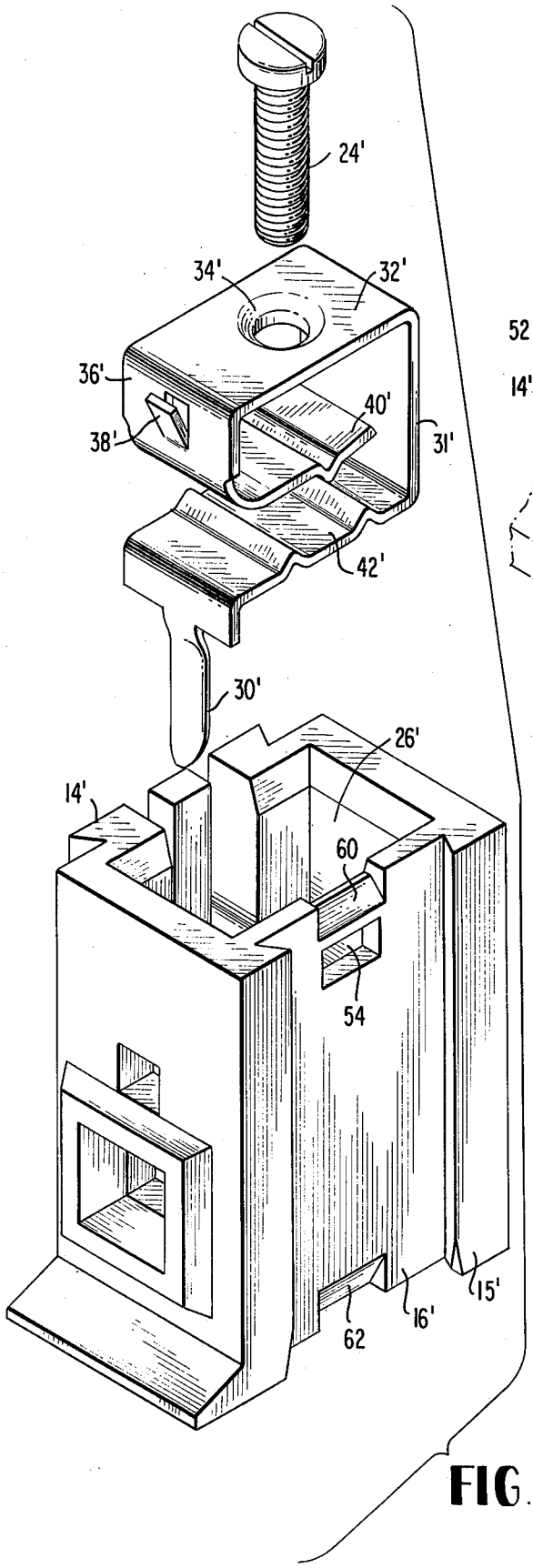
FIG. 6
FIG. 4
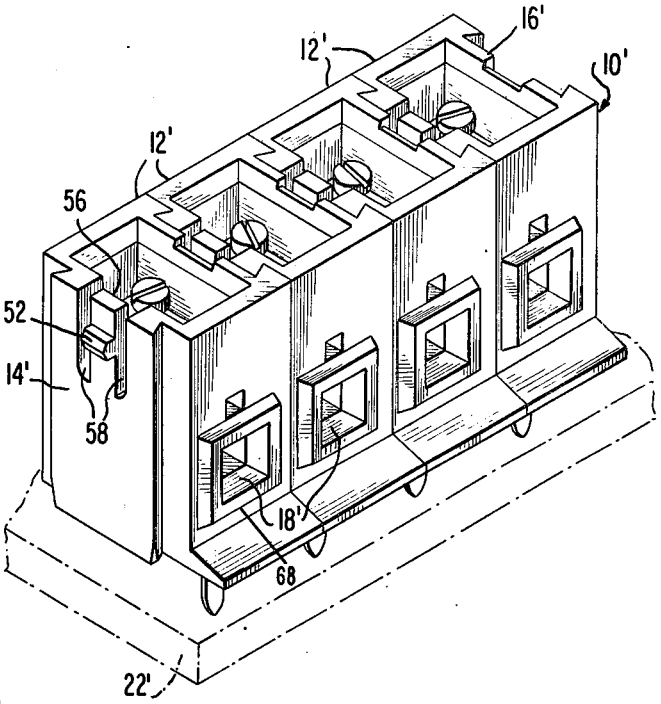
FIG. 5
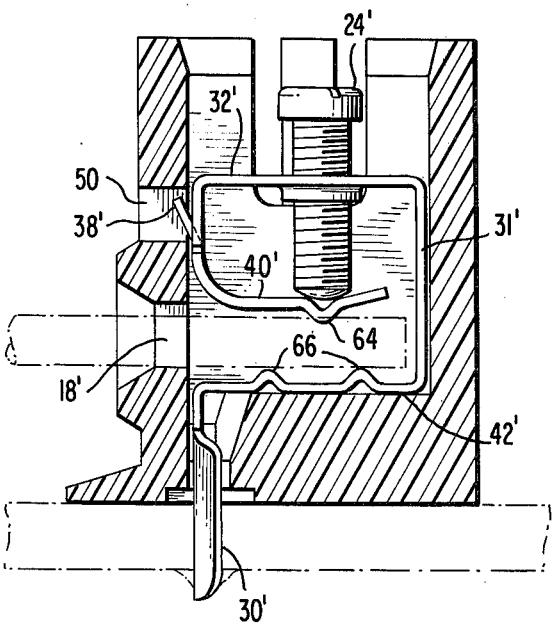

VARIABLE LENGTH ELECTRICAL CONNECTOR

REFERENCE TO RELATED APPLICATION

This application is a continuation-in-part of copending application Ser. No. 435,801, filed Jan. 23, 1974, and now abandoned.

BACKGROUND OF THE INVENTION

Various types of connector devices have been devised to facilitate the making of electrical connections to the terminals on a printed circuit board. In many instances, the connectors which may be available in various standard sizes do not have a terminal capacity that suitably matches the number of terminals on the circuit board. It is therefore desirable to provide a connector which is capable of being made to any desired length by assembling a desired number of individual modules or units.

It is known in the art to provide, in general, a variable length connecting means comprising a plurality of individual connectors which may be coupled end-to-end, such a device being shown in the Barnard U.S. Pat. No. 3,701,087. Such prior art device, however, is not adapted for the connection of a plurality of individual conductors to a circuit board. Also, this reference does not disclose an arrangement whereby an electrical conductor can be inserted into an aperture in the sidewall of the external housing in a transverse direction, i.e. both at right angles to the axial length of the housing and at right angles to the direction of coupling of a plurality of such connector devices, and with such conductor being clamped in place by the tightening of an axially aligned screw. Thus, the connecting device of Barnard is not capable of being used in the manner contemplated for the connecting device of the present invention.

SUMMARY OF THE INVENTION

The invention relates to an electrical connector unit or module which is particularly adapted to permit a plurality of such units to be joined end-for-end to provide a variable length connector means whereby a plurality of individual conductors, one for each joined unit, may individually be electrically connected to, for example, a printed circuit board. Each connector unit has an exterior housing which defines on its opposite external sides complementary male and female dovetail connecting means thereby permitting any desired number of the units to be secured together end-for-end to form a variable length connecting means. An axial bore in the housing receives an electrically conductive connecting element comprising a conductor clamping means actuatable by an axially positioned screw for clamping the end of an electrical conductor which is inserted through an aperture defined in one of the sidewalls other than one which defines a dovetail connecting part.

Each electrical conductor which is desired to be connected to the circuit board may be inserted through an opening in a sidewall of a respective one of the units, and be securely connected both electrically and mechanically by turning down the clamping screw. Each connector unit has a projecting pin which is connected electrically to the conductor clamping means. Thus, a connector means of any desired length may be provided and coupled mechanically to a circuit board so that each conductor is connected electrically to a respective aperture in the circuit board.

BRIEF DESCRIPTION OF THE DRAWINGS

In describing the invention, reference will be made to the accompanying drawings in which:

FIG. 4 is a perspective view showing the variable length connector means of an alternative embodiment of the invention;

FIG. 5 is a cross-sectional view of an individual one of the plurality of connector units shown in FIG. 4; and FIG. 6 is an exploded view of the connector means of this invention.

DETAILED DESCRIPTION OF THE PREFERRED EMBODIMENT

Figure 1:
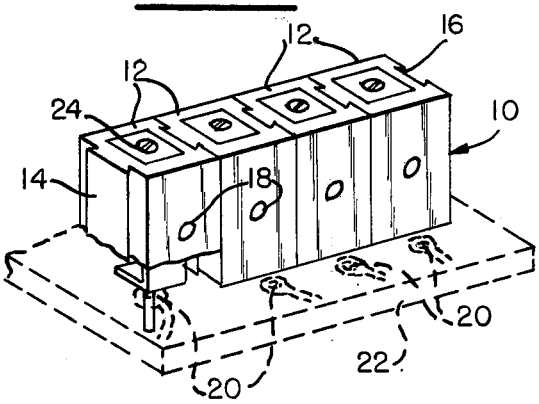
FIG. 1 is a perspective view showing the variable length connector means of one embodiment of the present invention.

FIG. 1 illustrates the variable length connector 10 as comprising a plurality of interconnected units 12 each forming an individual conductor connecting device. Each of the units 12 is provided on its opposing sidewalls with matable male and female dovetail coupling means 14 and 16, respectively, to permit any desired number of such units 12 to be mechanically coupled. Each unit 12 is shown as also having an aperture 18 in one of its sidewalls other than a sidewall defining a dovetail connecting means 14 and 16, and the function of such aperture is to receive the end of an electrical conductor which is intended to be mechanically coupled to a respective connector unit 12 and to be electrically connected to a respective one of the apertures 20 comprising a terminal for a printed circuit board 22.

Figure 3:
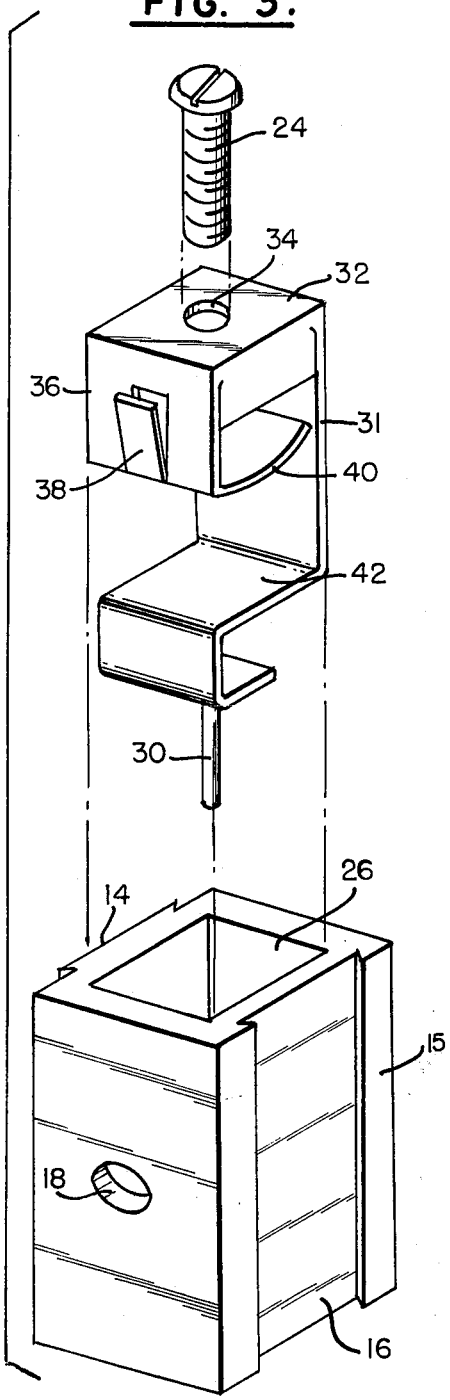
FIG. 3 is an exploded view of the connector means of this invention.
Figure 2:
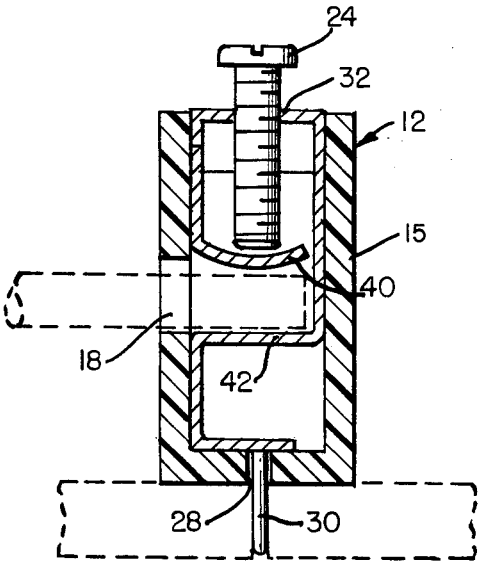
FIG. 2 is a cross-sectional view of an individual one of the plurality of connector units shown in FIG. 1.

FIG. 2 illustrates in cross-section one of the individual connecting devices 12 shown in FIG. 1. Such connector 12 is shown as comprising an external housing 15 which may be generally of rectangular cross-section and formed of an electrically insulating material. As shown in FIG. 3, as well as in FIG. 2, the housing 15 is provided with an elongate axial bore 26 which is essentially a blind bore as shown in FIG. 2 except that such bore 26 does communicate with the exterior of the housing 15 at its blind end through a small aperture 28. A transverse opening 18 is provided in the housing 15, such transverse opening extending through only one of the sidewalls and into the axial bore 26, and it will be noted from FIG. 3 as well as FIG. 1 that such transverse bore 18 is formed in one of the lateral sidewalls other than those defining the dovetail connecting parts 14 and 16.

The metallic conductor clamping means 31 is shown in FIG. 2 as being inserted into the axial bore 26 of housing 15 and with the projecting pin 30 thereof extending through the aperture 28 at the bottom of housing 15. The clamping means of FIG. 3 comprises a generally rectangular upper portion 32 defining a threaded aperture 34 for receiving screw 24. The wall 36 has a tab 38 formed therein, such tab being bent slightly outwardly as shown in FIG. 3 so as to provide frictional resistance to ensure that the connector element cannot readily be removed from the housing 15 after having once been inserted therein. The end tab 40 together with the portion 42 comprise the opposing faces of a wire clamping means which are effective to tightly grip the end of a conductor inserted through transverse bore 18 as shown in a dotted line in FIG. 2. Thus, when the screw 24 is threaded into the upper surface 32 of conductor clamping element 31, the projecting end tab 40 is bent downwardly by the end of screw 24 and clamps the conductor between such end tab 40 and the portion 42.

FIG. 2 shows that the clamping means is so formed that portion 42 normally lies slightly above the lower level of aperture 18 so that this portion as well as the opposed portion 40 can be tightly urged against a conductor to clamp it in place when screw 24 is turned down into portion 32.

It will be noted that the clamping means of FIG. 3 is so constructed that it can be fabricated almost entirely from a single flat piece of metal, with pin 30 preferably welded thereto in the position shown. The clamping means may, of course, be of a different form from that shown, and may, for example, be formed of a section of metallic rod, of any suitable cross-section such as square or hexagonal and having a transverse aperture therein for receiving the conductor, together with axially oriented screw means for clamping the conductor.

Referring now to the alternative embodiment of FIGS. 4, 5, and 6, it will be noted that the reference characters used there correspond to those used in FIGS. 1, 2, and 3 for corresponding parts but with a prime added thereto. Also, because of the similarities in the two disclosed embodiments, the description given here to the embodiment of FIGS. 4–6 will be directed particularly to the difference of this embodiment over that shown in FIGS. 1–3.

FIGS. 4 and 5 show that a through aperture 50 is provided in the same sidewall of each unit 12' which defines the aperture 18' for receiving the wire to be connected to the circuit board. Such aperture 50 receives the tab 38' on conductor clamping means 31' when the latter is slidably inserted into unit 12' and thus prevent its removal unless a tool such as a screwdriver is inserted into aperture 50 to bend the resilient tab 38' back so that it will not abut the wall portion which defines aperture 50 as the clamping means 31' is slid out of the axial bore 26'.

Locking means is also provided on the mating surfaces 14' and 16' of each unit 12' to ensure accurate positioning of a series of units 12' relative to each other as they are joined to form an elongate connector and also to prevent their inadvertently becoming dissassembled. Such locking means comprises a protuberance 52 on the male dovetail part 14' which engages with a recess 54 on the female dovetail portion 16' of an adjacent unit 12'. Protuberance 52 is resiliently supported on a prong-like tab 56 fromed by slots 58. Bevelled portions 60 and 62 on portion 16' make it possible for tab 56 to bend inwardly as adjacent units 12' are slidably coupled and thereby facilitate entry of protuberance 52 into recess 54.

To permit the securing of the connected wire in an improved manner, the conductor clamping means 31' is provided with a transverse ridge 64 on its portion 40' and with a pair of similar ridges 66 on its opposed portion 42'. Improved economy in manufacture is achieved by forming the downwardly projecting pin 30' on the forward portion of the clamping means 31' rather than as shown in FIGS. 1–3.

To facilitate the connection of conductors to an assembly of connectors as shown in FIG. 4, a protruding bevelled entranceway 68 is provided for aperture 18'. This serves to provide quick visual identification to an assembler by distinguishing readily over the aperture 50.

What I claim is:

1. Electrical connector means comprising in combination:

an elongate electrically conductive conductor clamping element defining a longitudinal bore extending therein from one end and also a transversely extending bore, securing means in said longitudinal bore and movable along the axis of said longitudinal bore for bearing against a conductor inserted into said transverse bore, a pin projecting axially from said element at its other end, an elongate electrically insulating housing having an internal elongate substantially blind bore extending from one end for slidably receiving said element in the direction of the axis of said blind bore and with said axis of said blind bore being parallel to said longitudinal bore, said housing defining therein a bore transverse to said axis and extending through one sidewall thereof so as to communicate with said internal blind bore of said housing and being also aligned with said transverse bore in said element, an axial aperture in the other end of said housing extending into said blind bore in said housing through which projects said pin when said conductor clamping element is slidably inserted into said internal bore of said housing to permit external electrical connection thereto and thus to a conductor inserted into the aligned transverse apertures in said housing and said element.

2. The electrical connector of claim 1 wherein said conductor clamping element and also said internal blind bore in said housing which receives said element both having mating non-circular configurations permitting insertion of said element into said housing only with at least one predetermined relative orientation to facilitate thereby the alignment of said transverse bore of said element with said transverse bore of said housing.

3. The electrical connector of claim 1 wherein said conductor clamping element includes an outwardly projecting tab for frictionally retaining said element within said axial bore in said housing.

4. The electrical connector means of claim 1 wherein said conductor-clamping element comprises first and second opposed portions which therebetween define said second transversely extruding bore, and ridges formed on said opposed portions for bearing frictionally against a conductor inserted into said connector means.

5. The electrical connector of claim 1 wherein said housing defines on opposite exterior sidewalls thereof and at right angles to the sidewall having said transverse bore therein matable female and male interconnecting means respectively for coupling together a plurality of said housings to provide a connecting means of any desired length.

6. The electrical connector means of claim 5 wherein said interconnecting means permit the slidable interconnection of a pair of said housings in the direction of the axis of said blind bore, and locking means for releasably locking said housings when they are slidably aligned with each other.

7. The electrical connector means of claim 6 wherein said locking means includes a protuberance on one said housing fitting into a recess on the other of said pair of housings.

8. The electrical connector means of claim 7 wherein said protuberance is supported on a resilient support which urges said protuberance into said recess.

* * * * *